United States Patent [19]

Mitchell

[11] Patent Number: 4,868,925

[45] Date of Patent: Sep. 26, 1989

[54] FOOTBALL SHOULDER PADS WITH ACCORDIAN-HINGE FLAP

[75] Inventor: Hal D. Mitchell, Licking, Mo.

[73] Assignee: Figgie International Inc., Richmond, Va.

[21] Appl. No.: 238,285

[22] Filed: Aug. 30, 1988

[51] Int. Cl.[4] ..... A41D 13/00

[52] U.S. Cl. ..... 2/2

[58] Field of Search ..... 2/2, 45

[56] References Cited

U.S. PATENT DOCUMENTS 4,295,227 10/1981 Mitchell ..... 2/2
4,322,859 4/1985 Mitchell ..... 2/2
4,435,851 3/1984 Mitchell et al. ..... 2/2

*Primary Examiner*—Ronald Feldbaum
*Attorney, Agent, or Firm*—Senniger, Powers, Leavitt and Roedel

[57] ABSTRACT

A shoulder pad for football players, the shoulder pad comprising a left-side member adapted to fit over the left shoulder and a right side member adapted to fit over the right shoulder. Each side member comprises a chest panel and a back panel, adapted to extend over at least a portion of the wear's chest and back, respectively, the top edges of the chest panel and the back panel difining between them an opening over the top of the wear's shoulder. A flap overlies the opening. Front and back hinge sections ae hingedly attached to the top edges of the chest and back panels, respectively, and to the front and back edges of the flap respectively.

17 Claims, 3 Drawing Sheets

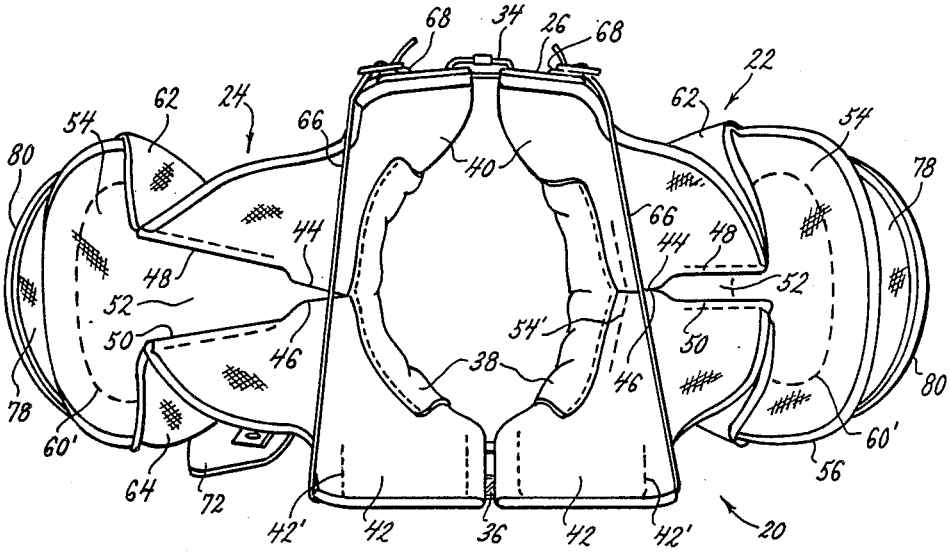

FOOTBALL SHOULDER PADS WITH ACCORDIAN-HINGE FLAP

BACKGROUND OF THE INVENTION

This invention relates to football shoulder pads, and in particular to an improved flap for such shoulder pads that moves to accommodate the motion of the shoulder while remaining in protective position relative to the shoulder.

Football shoulder pads provide protection from impacts to the shoulder and upper body of the wearer. There are two principal, and sometimes competing, interests in the design of these shoulder pads: maximizing the protection to the wearer's body while minimizing restrictions on the wearer's movement. A particular problem has been the design of a shoulder pad to protect the wearer's shoulder, while allowing the wearer to freely raise his arms. Protective shoulder pads generally interfere with the movement of the shoulder and therefore restrict or impair arm movement.

As the arms are raised, the gleno-humeral shoulder joint accommodates the motion of the arm until it is about horizontal. As the arm is raised further, the center of motion shifts to sterno-clavical joint, which causes the shoulder to rise as the arm continues to move upwardly. Thus, when the arm is raised straight up, the shoulder is virtually adjacent the ear. Some shoulder pad constructions have been made to accommodate this movement of the shoulder and allow greater freedom of arm movement. Examples of such shoulder pads are shown in U.S. Pat. Nos. 4,332,859, 4,320,537 and 3,740,763 incorporated herein by reference.

SUMMARY OF THE INVENTION

It is among the objects of the present invention to provide an improved shoulder pad which allows greater mobility of the upper body of the wearer, and particularly the shoulders, so that the arms may be raised without undue interference from the shoulder pads; the provision of such a shoulder pad that moves to accommodate the movement of the shoulder as the arms are raised, yet remains in a protective position relative to the shoulder; and, the provision of such a shoulder pad that is of compact and simple design.

Generally, the shoulder pad of the present invention comprises a left-side member adapted to fit over the left shoulder and a right-side member adapted to fit over the right shoulder. Each of the members comprises a chest panel and a back panel. The chest panel and the back panel are connected at their medial sides for pivoting about a vertical axis generally adjacent the wearer's neck. The top edges of the chest and back panels define between them an opening over the top of the wearer's shoulder. Each member further comprises a flap overlying the opening between the panels. The flap is hingedly attached at its medial end to its respective side member. The flap is also connected to the chest and back panels with front and back hinge sections. These hinge sections have first and second opposite edges, the first edges of the front and back hinge sections are hingedly connected to the top edges of the chest and back panels, respectively, and the second edges of the front and back hinge sections are hingedly connected to the flap, generally adjacent the front and back edges of the flap, respectively. The flap is mounted over the opening to accommodate movement of the shoulder while remaining in position to protect the shoulder. Thus the shoulder pad of this invention allows the shoulders to freely move upwardly with the upward movement of the arms, and therefore does not restrict or impair arm movement.

These and other advantages of the invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
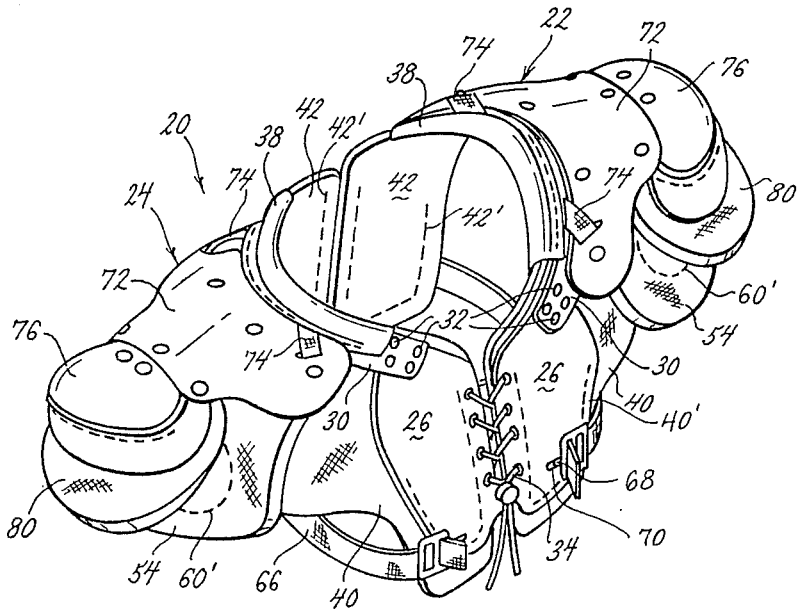
FIG. 1 is a perspective view of a shoulder pad constructed according to the principles of the present invention.
Figure 2:
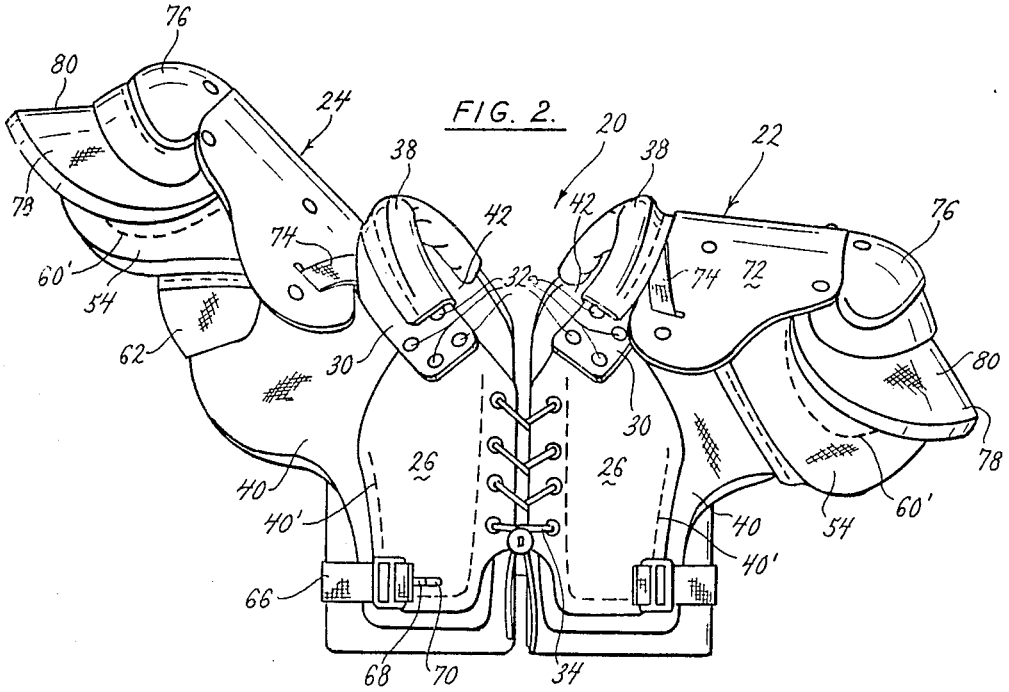
FIG. 2 is a front elevation view of the shoulder pad, with the right-side flap (left as shown in the FIG.) raised as it would be to accommodate the right arm.
Figure 3:
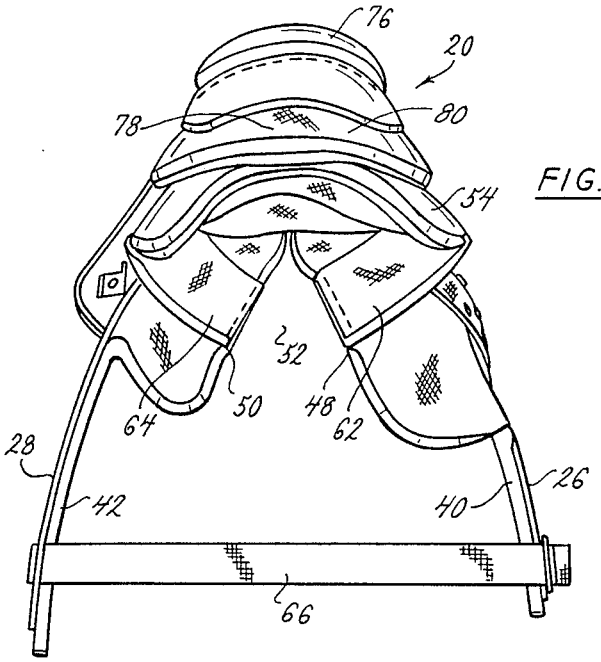
FIG. 3 is a side elevation of the right side of the shoulder pad, with the right-side flap raised.
Figure 7:
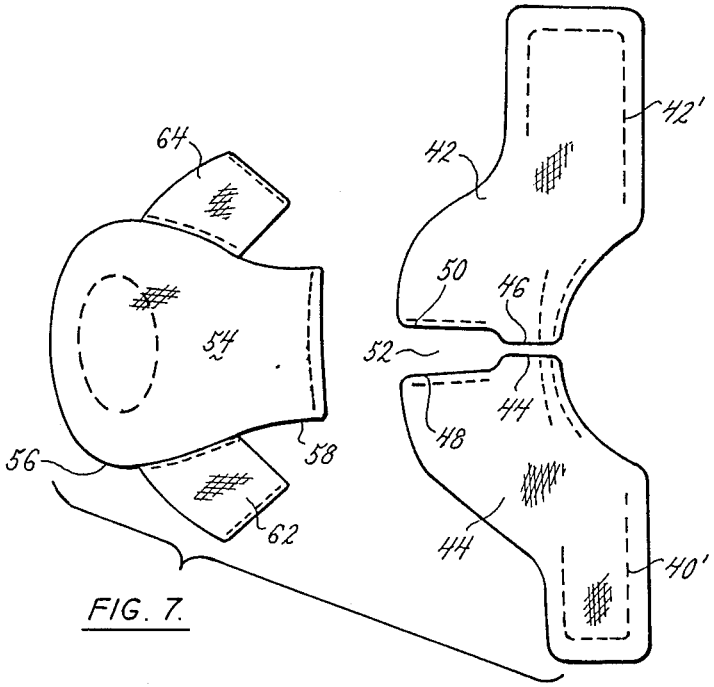
FIG. 7 is an exploded bottom plan view of the flap, hinge sections, and chest and back panels of one side of the shoulder pads of the present invention.
Figure 4:
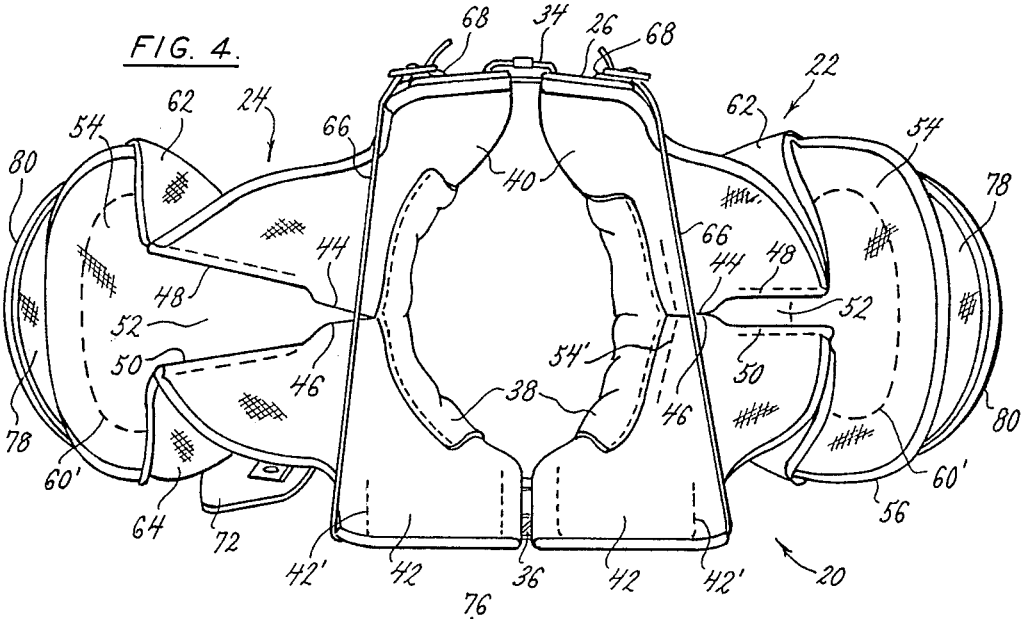
FIG. 4 is a bottom plan view of the shoulder pad, with the right-side flap (left as shown in the FIG.) raised.
Figure 5:
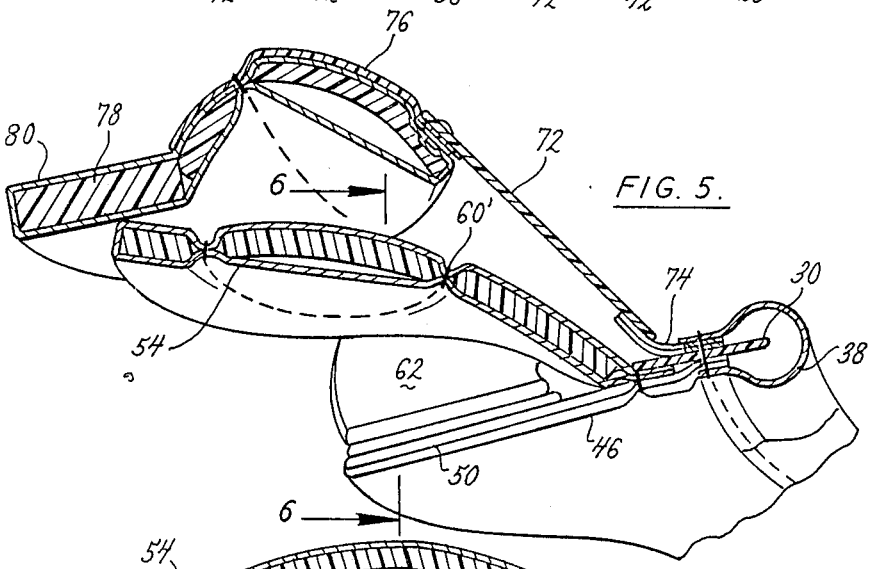
FIG. 5 is a partial cross-sectional view of the shoulder pad.
Figure 6:
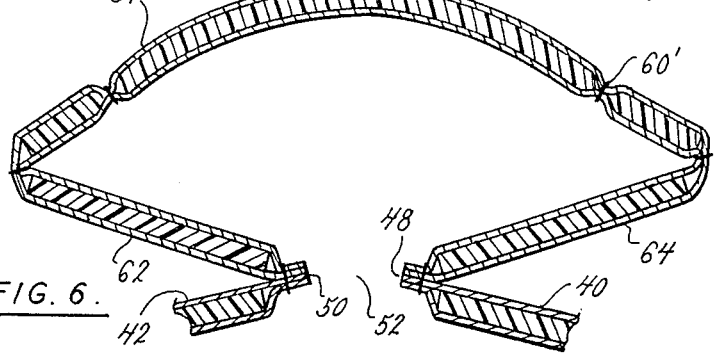
FIG. 6 is a transverse cross-sectional view taken along the plane of line 6—6 in FIG. 5, showing the hinged mounting of the flap.

A football shoulder pad constructed according to the principles of this invention is indicated generally as 20 in FIGS. 1–4. The shoulder pad 20 comprises a left-side member 22 adapted to fit over the player's left shoulder, and a right-side member 24 adapted to fit over the player's right shoulder. The left and right side members 22 and 24 are of generally inverted U-shape as viewed from the side, for example as shown in FIG. 3. The left and right side members 22 and 24 are substantially mirror images of each other, and each comprises a chest plate 26 and a back plate 28, connected by an arch 30 extending over the shoulder, adjacent the wearer's neck. The arch 30 may be secured to the plates 26 and 28 with rivets 32, or it may be made integrally with the plates.

The plates 26 and 28, and the arch 30, are preferably made from a relatively lightweight plastic, such as a high density polyethylene, having a sufficiently high impact resistance to withstand the heavy blows received during the course of a football game. The front plates 26 of the left-side and right-side members 22 and 24 are preferably secured together at their medial edges as with lacing 34. Similarly, the back plates 28 of the left-side and right-side members 22 and 24 are preferably secured together at their medial edges as with lacing 36. The medial side edge of each arch 30 is provided with padding 38 to protect the side of the wearer's neck.

Each of the side members 22 and 24 further comprises body padding also having an inverted U-shape when viewed from the side, for example as shown in FIG. 3. This body padding comprises a chest panel 40 and a back panel 42. The chest panel 40 is secured to the chest plate 26 as with stitching 40', and extends laterally beyond the chest plate 26 to cover the front of the wearer's shoulder. Similarly, the back panel 42 is secured to the back plate 28 as with stitching 42', and extends laterally beyond the back plate 28 to cover the back of the wearer's shoulder. These panels preferably comprise a suitable closed cell elastomeric vinyl foam in a stretch fabric cover.

The top edges of the chest and back panels 40 and 42 may be connected at their medial sides, or by virtue of their attachment to the chest plate and back plate, respectively, are at least held in close proximity. The top edges of the chest and back panels 40 and 42 preferably each comprise first reaches 44 and 46, respectively, on their respective medial sides, which generally abut, and second reaches 48 and 50, respectively, on their respective lateral sides which are generally spaced apart. Thus the chest and back panels define between them an opening 52 over the top of the wearer's shoulder. As best shown in the right side of FIG. 4, the first reaches 44 and 46 of the chest and back panels normally abut. However, these panels are sufficiently flexible that when the shoulder rises, the panels can pivot about a vertical axis generally adjacent the wearer's neck, (the point of their connection). Thus, as shown in the left side of FIG. 4, the first reaches 44 and 46 separate, and the opening 52 widens to accommodate the wearer's shoulder.

A flap 54 is positioned to overlie the opening 52, and is mounted to move to accommodate movement of the shoulder joint while remaining in position to protect the shoulder joint. Flap 54 is preferably made from the same type of padding as the chest and back panels and has a generally teardrop shape, with a bulbous body 56 and a tapering neck 58. A concave oval cap (not shown) may be secured to the top surface of the bulbous body 56 of flap 54. The cap is preferably made from the same relatively lightweight, impact resistant plastic and the chestplate and backplate, or from some other suitable material. The cap provides additional protection for the top of the shoulder and also imparts a generally concave shape to the flap 54 so that it covers the shoulder. Alternatively, as shown a ring of stitching 60' can be provided to shape the flap 54.

The medial edge of the tapering neck 58 of the flap 54 is hingedly secured to its respective side member as with stitching 54'. Thus flap 54 pivots about a horizontal, front-to-back axis. The flap 54 is further hingedly secured to the chest and back panels by front and rear hinge sections 62 and 64, which are preferably made from the same type of padding as the front and back panels. The hinge sections 62 and 64 have first and second side edges which diverge in the lateral direction. The first side edge of front hinge section 62 is hingedly attached to the second reach 48 of the chest panel 40, and the second side edge the front hinge section is hingedly attached generally adjacent the front edge of the flap 54. This hinged attachment may be accomplished, for example, by stitching. The first side edge of the back hinge section 64 is hingedly attached to the second reach 50 of the back panel 42, and the second side edge of the back hinge section 64 is hingedly attached generally adjacent the back edge of the flap 54. Again, this hinged attachment may be accomplished, for example, by stitching. Thus, as the wearer's shoulder rises up through opening 52, flap 54 rises with the shoulder remaining in protective position relative to the shoulder, and the front and back hinge sections 62 and 64 rise as well, maintaining the position of the flap 54, and protecting the front and back of the shoulder while it is raised.

The chest plate 26 and the back plate 28 of each side member may be interconnected with an elastic belt 66 to secure shoulder pad 20 on the wearer. The belt 66 preferably extends from the back plate 28 and is secured to the chest plate by means of T-bars 68 on the ends of the belts 66 which engage slots 70 in the chest plates 26.

A secondary protective structure is preferably provided for the shoulder. This structure preferably comprises a concave curved top-plate 72 hingedly attached at its medial end to its respective side member as with straps 74. The top plate 72 is preferably made from the same lightweight, impact resistant plastic as the chest plates and back plates, or from some other suitable material. A concave, oval cap 76 is secured to the lateral end of the top plate 72, as with rivets. The oval cap 76 is also preferably made from the same lightweight, impact resistant plastic as the chest plates and back plates, or from some other suitable material. A pad 78 is secured to the concave underside of the cap 76, and extends substantially beyond the edges of cap 76 forming a large brim 80. The cap 76 provides additional protection for the top of the shoulder and also imparts a generally concave shape to the pad 78 so that it covers the top and a portion of the front, back, and side of the shoulder.

OPERATION

In operation, the padding and the various plates of the shoulder pad operate to protect the wearer's upper body, and particularly the shoulders, from the impacts typically experienced while playing football. However, in contrast to many of the prior art shoulder pads, shoulder pad 20 readily accommodates the upward movement of the shoulders, and thus readily permits the player to raise his arms. As the shoulders rise, the front panel 40 and the back panel 42 separate, pivoting about their point of connection. As these panels 40 and 42 separate, the opening 52 widens so that the shoulder can rise. As the opening 52 widens, and the shoulder rises, the flap 54 rises, remaining in protective position relative to the shoulder. The hinge sections 62 and 64 rise with flap 54, expanding much like an accordion, maintaining its proper positioning and protecting the front and the back of the shoulder while the shoulder is raised.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A shoulder pad for football players, the shoulder pad comprising a left-side member adapted to fit over the left shoulder and a right side member adapted to fit over the right shoulder, each of said side members comprising:

a chest panel and a back panel, adapted to extend over at least a portion of the wearer's chest and back, respectively, the top edges of the chest panel and the back panel defining between them an openig over the top of the wearer's shoulder;

a flap overlying the opening;

front and back hinge sections having opposite first and second edges, the first edges of the front and back hinge sections being hingedly attached to the top edges of the chest and back panels, respectively, and the second edges of the front and back hinge sections being hingedly attached to the flap, generally adjacent the front and back edges of the flap, respectively.

2. The shoulder pad according to claim 1 wherein the medial end of the flap is hingedly attached to the top of its respective side member for pivoting about a generally horizontal, front-to-back axis.

3. The shoulder pad according to claim 1 wherein the lateral portions of the front and back panels can separate to enlarge the opening to accommodate the wearer's shoulder.

4. The shoulder pad according to claim 1 wherein the chest and back panels are connected at their medial sides.

5. The shoulder pad according to claim 4 wherein the chest panel and back panel flex about a point adjacent the wearer's neck to allow the lateral sides of the panels to separate to enlarge the opening to accommodate the wearer's shoulder.

6. The shoulder pad according to claim 1 wherein the top edges of the chest and back panels are connected at their medial sides, and wherein the top edges comprise first reaches, on their respective medial sides which generally abut, and second reaches, on their respective lateral sides which are spaced apart to define an opening over the shoulder of the wearer, the panels being adapted to flex with respect to each other so that the opening between the panels can widen to accommodate the shoulder of the wearer.

7. The shoulder pad according to claim 6 wherein the medial end of the flap is hingedly attached to the top of its respective side member for pivoting about a generally horizontal, front-to-back axis.

8. A shoulder pad for football players, the shoulder pad comprising a left-side member adapted to fit over the left shoulder and a right side member adapted to fit over the right shoulder, each of said side members comprising:

a chest panel and a back panel for covering the wearer's chest and back, respectively, the lateral portions of the top edges of the panels defining an opening between them over the top of the wearer's shoulder, the lateral portions of the panels being separable to enlarge the opening to accommodate the wearer's shoulder;

a flap overlying the opening;

front and back hinge members having first and second opposite edges, the first edges of the front and back hinge members being hingedly connected to the top edges of the chest and back plates, respectively, and the second edges of the front and back hinge members being hingedly connected to the flap, generally adjacent the front and back edges of the flap.

9. The shoulder pad according to claim 8 wherein the medial end of the flap is hingedly attached to the top of its respective side member for pivoting about a generally horizontal, front-to-back axis.

10. The shoulder pad according to claim 8 wherein the chest and back panels are connected at their medial sides.

11. The shoulder pad according to claim 10 wherein the chest panel and back panel flex about a point adjacent the wearer's neck to allow the lateral sides of the panels to separate to enlarge the opening to accommodate the wearer's shoulder.

12. The shoulder pad according to claim 11, wherein the top edges of the chest and back panels are connected at their medial sides, and wherein the top edges comprise first reaches, on their respective medial sides which generally abut, and second reaches, on their respective lateral sides which are spaced apart to define an opening over the shoulder of the wearer, the panels being adapted to flex with respect to each other so that the opening between the panels can widen to accommodate the shoulder of the wearer.

13. The shoulder pad according to claim 12 wherein the medial end of the flap is hingedly attached to the top of its respective side member for pivoting about a generally horizontal, front-to-back axis.

14. A shoulder pad for football players, the shoulder pad comprising a left-side member adapted to fit over the left shoulder and a right side member adapted to fit over the right shoulder, each of said members comprising:

a chest panel and a back panel, adapted to cover at least a portion of the wearer's chest and back, respectively, the top edges of the chest and back panels comprising first reaches on the respective medial sides of the panel, in generally abutting relationship, and second reaches on the respective lateral sides of the panels, being spaced apart to define an opening over the top of the wearer's shoulder, the panels being moveable relative to each other to widen the opening to accommodate the wearer's shoulder;

a flap overlying the opening;

front and back hinge sections having first and second opposite edges, the front and back hinge sections adapted to mount the flap over the opening to move to accommodate movement of the shoulder joint while remaining in position to protect the shoulder joint, the first edges of the front and back hinge sections being hingedly connected to the second reaches of the top edges of the chest and back panels, respectively, and the second edges of the front and back hinge sections being hingedly connected to the flap, generally adjacent the front and back edges of the flap, respectively.

15. The shoulder pad according to claim 14 wherein the first and second edges of the hinge sections diverge in the lateral direction.

16. The shoulder pad according to claim 14 wherein the flap is generally teardrop shaped having a bulbous lateral body section and tapering medial neck portion.

17. The shoulder pad according to claim 16 wherein the medial end of the flap is hingedly attached to the top of its respective side member for pivoting about a generally horizontal, front-to-back axis.

* * * * *